US012680701B2

(12) United States Patent
Walther et al.

(10) Patent No.: US 12,680,701 B2
(45) Date of Patent: Jul. 14, 2026

(54) EXTRACTING DEVICE FOR REMOVING AIR, COMBINATION APPLIANCE AND SUCTION ARM

(71) Applicant: ELECTROLUX APPLIANCES AKTIEBOLAG, Stockholm (SE)

(72) Inventors: Christoph Walther, Rothenburg ob der Tauber (DE); Nikolai Schneider, Rothenburg ob der Tauber (DE); Frank Benold, Porcia (IT); Linnéa Karlsson, Stockholm (SE); Thomas Gardner, Stockholm (SE); Pravin Kumar, Rothenburg ob der Tauber (DE); Ines Radhima, Forli (IT); Rosolino Rezzola, Forli (IT); Diana Rodrigues Valerio, Rothenburg ob der Tauber (DE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 374 days.

(21) Appl. No.: 18/271,837

(22) PCT Filed: Dec. 17, 2021

(86) PCT No.: PCT/EP2021/086512
§ 371 (c)(1),
(2) Date: Jul. 11, 2023

(87) PCT Pub. No.: WO2022/152505
PCT Pub. Date: Jul. 21, 2022

(65) Prior Publication Data

US 2024/0142112 A1 May 2, 2024

(30) Foreign Application Priority Data

Jan. 12, 2021 (EP) ..... 21151055

(51) Int. Cl.
*F24C 15/20* (2006.01)

(52) U.S. Cl.
CPC ..... *F24C 15/2042* (2013.01); *F24C 15/2085* (2013.01); *F24C 15/2092* (2013.01)

(58) Field of Classification Search
CPC ... F24C 15/2085; F24C 15/2092; A45D 20/34
See application file for complete search history.

(56) References Cited

U.S. PATENT DOCUMENTS 274,408 A * 3/1883 Taylor ..... A47J 36/38 126/300
2,554,694 A * 5/1951 Belt ..... F24C 15/2092 415/121.2

(Continued)

FOREIGN PATENT DOCUMENTS

DE 3503236 A1 * 8/1986
DE 10112802 9/2002

(Continued)

OTHER PUBLICATIONS

International Search Report and Written Opinion for PCT/EP2021/086512, dated Mar. 21, 2022, 10 pages.

(Continued)

*Primary Examiner* — Jorge A Pereiro
(74) *Attorney, Agent, or Firm* — Chrisman Gallo Tochtrop LLC

(57) ABSTRACT

The present invention is related to an extraction device (14) for removing air from an area above a cooking hob (12). The extraction device (14) comprises a suction arm (26), a fan and an outlet opening (34). The suction arm (26) includes a suction head (28), which comprises a suction opening (32), and a suction base (30), which comprises an air duct for conducting the air. The air duct is arranged downstream of the suction opening (32). The is configured to suck in the air from the area above the cooking hob (12) through the suction opening (32) and the air duct. The outlet opening (34) is configured to exhaust air. According to the invention, (Continued)

the suction arm (26) is centrally arranged or arrangeable in relation to the cooking hob (12) or is arranged or arrangeable midway between the lateral edges of the cooking hob (12). Further, the position of the suction head (28) and/or of the suction opening (32) is changeable from a position within the boundary lines and at least approximately at the height level of a cooktop (18) of the cooking hob (12) to an elevated position above the height level of the cooktop (18).

15 Claims, 3 Drawing Sheets

(56) References Cited

U.S. PATENT DOCUMENTS 3,653,318 A * 4/1972 Shimosawa ..... F24C 15/2064 126/299 D
4,163,650 A * 8/1979 Watson ..... B03C 3/32 55/467
5,036,754 A * 8/1991 Simms ..... B08B 15/00 454/65
5,133,691 A * 7/1992 Karlsson ..... B08B 15/02 454/56
D434,486 S * 11/2000 Segers ..... D23/370
6,322,754 B1 * 11/2001 Buchmann ..... B25H 1/20 454/56
6,647,978 B1 * 11/2003 Khosropour ..... F24C 15/2042 126/299 R
9,981,351 B2 * 5/2018 Vanier ..... B23K 26/142
2002/0029696 A1 * 3/2002 Grimm ..... F24C 15/2092 99/403
2003/0226444 A1 * 12/2003 Khosropour ..... F24C 15/2035 95/273
2003/0226558 A1 12/2003 Khosropour et al.
2003/0226559 A1 * 12/2003 Khosropour ..... F24C 15/2035 126/299 R
2003/0226560 A1 * 12/2003 Shekarri ..... F24C 15/2021 126/299 R
2007/0163570 A1 * 7/2007 Roy ..... F24C 15/2021 126/299 R
2009/0074609 A1 * 3/2009 Malyon ..... F24C 15/20 422/123
2012/0111845 A1 * 5/2012 Simms ..... B08B 15/002 219/137 R
2016/0054007 A1 * 2/2016 Rieger ..... F24C 15/2085 126/299 D
2017/0016630 A1 * 1/2017 Yang ..... F24C 15/2092
2018/0073745 A1 * 3/2018 Norman ..... F24F 7/04
2018/0313546 A1 * 11/2018 Kim ..... F24C 15/2092
2019/0301745 A1 * 10/2019 Neal ..... F24C 15/10

FOREIGN PATENT DOCUMENTS

DE 10112804 A1 * 9/2002 ..... F24C 15/2085
DE 102013014895 10/2014
DE 102018220681 6/2020
JP S63267854 A * 11/1988
KR 101891256 8/2018
WO WO-2009104141 A1 * 8/2009 ..... F16K 3/03

OTHER PUBLICATIONS

EP Communication for application No. 21840597.5 dated Apr. 9, 2025, 11 pages.

* cited by examiner

EXTRACTING DEVICE FOR REMOVING AIR, COMBINATION APPLIANCE AND SUCTION ARM

During the performance of cooking activities under use of a cooking hob, cooking vapours are generated, which are distributed over the cooking area. In order to avoid these cooking vapours to be spread throughout the entire kitchen space, an arrangement of an extraction device, particularly an extractor hood, is common. Said extraction device is operated in parallel to the cooking hob, thereby sucking in these cooking vapours in order to filter out particles and tiny droplets from the vapours and/or to blow the vapours to the outside of the building. While it has been common use to arrange such an extractor hood above the cooking area, in recent years downdraft extraction devices have been finding a growing market. Such kind of extraction device is usually arranged below a cooktop of the related cooking hob and it comprises at least one fan for sucking air from the cooking area through an opening or recess arranged in the cooktop. In such systems, the air is moved through a ventilation channel from the cooking zone to the bottom of a kitchen cabinet, where it is blown out and returned to the ambient air. Due to the provision of a ventilation channel inside of the related kitchen cabinet, storage space for e.g. cookware or other utensils is blocked. On the other hand, other systems are set up by dispensing said ventilation channel inside the cabinet and by directly blowing out the air through a cutout in a rear wall of the cabinet towards a kitchen wall. This, however, may cause mould formation as a result of humidity of the exhausted air, specifically when the kitchen wall is an outer wall. Moreover, the functionality of downdraft extraction devices is reduced, when high pots are used for the cooking process, because of the particular distance from the source of cooking vapours to the suction opening, which is on the same level as the worktop of the cooking hob. In order to overcome this drawback, DE 10 2018 220 681 A1 discloses an extraction device with a fan and a function unit having a suction opening and a filter unit, wherein the function unit is movably mounted at a non-moving part for being moved towards an elevated position above cooking zones on a related cooking hob. The embodiment disclosed in this document comprises swivel-mounted connecting arms arranged adjacent to the lateral edges of the cooking hob, which are configured to lift the function unit to said elevated position. In the position swivelled up, however, the connecting arm impede lateral access to the cooking zones, specifically a pulling away of cookware in sideways directions is hardly possible.

It is an object of the present invention to provide an extraction device comprising means for changing the position of a suction opening, which is arranged for sucking in air from an area above a cooking hob, from a position at a height level of a cooktop of the cooking hob to an elevated position, wherein said means for changing the position of the suction opening shall be designed in a way allowing unimpeded lateral access to each one of the cooking zones at least from the closest side edge of the cooking hob. A further object is to provide a combination appliance with such an extraction device. Finally, a suction arm shall be provided, which cooperates with or is connectable to such an extraction device.

An extraction device for removing air, which particularly contains cooking vapours, from an area above a cooking hob comprises a suction arm, a fan and an outlet opening. The suction arm includes a suction head, which comprises a suction opening, and a suction base, which comprises an air duct for conducting the air. Said air duct is arranged downstream of the suction opening. The fan is configured to suck in the air from the area above the cooking hob through the suction opening and, downstream thereof, through the air duct. The air is further conveyed in the interior of the extraction device and leaves it, in particular into the ambient air, through an outlet opening for air exhaustion. The extraction device particularly further comprises a filter element for removing particles and/or droplets and/or odours from the air sucked in through the suction opening. The filter element, which preferably includes a grease and/or odour filter function, is particularly arranged or arrangeable upstream of the fan. According to the present invention, the suction arm, in particular its suction base and/or suction head, is centrally arranged or arrangeable in relation to the cooking hob or is arranged or arrangeable midway between the lateral edges of the cooking hob. Such arrangement in the inner zone of the cooking area and away from the lateral edges of the cooking hob notably increases the cooking comfort, specifically the handling of cookware, since a pulling away of cookware in sideways directions is possible in a simple way. One preferred arrangement is characterized in that both a centre or centreline of the suction arm and a centreline of the cooking hob lie in one plane, which is vertically oriented. According to a further characteristic feature, the position of the suction head and/or of the suction opening is changeable from a position within the boundary lines and at least approximately at the height level of a cooktop of the cooking hob to an elevated position above the height level of the cooktop, which elevated position may be a predefined one or may be variable. With such arrangement of the suction head in whichever height positioning an unimpeded access to each cooking zone from a lateral direction, e.g. from a kitchen worktop after finalizing preparational work, is enabled.

The suction opening may be arranged on a bottom side of the suction head. This positioning may be favourable in case of an arrangement of the suction head at a level notably above the level of emerging cooking vapours. Sucking upwards may be performed by a flat aspiration direction, so that the cooking vapours from several cooking zones that may be arranged around a centralized suction opening may be pooled in a funnel-shaped way. Advantageously, the suction head, in particular the suction opening, is designed to perform a bowl-shaped or a cone-shaped aspiration direction, which provides a preferred alignment towards the individual cooking zones. An alternative positioning of the suction opening may be at least one lateral surface of the suction head, which causes a suction in an at least approximately horizontal direction. Such positioning is effective also in the case of a level of vapour generation nearly equal to the height positioning of the suction opening, which is favourably characterized by a comparably short suction distance. In any case, independently from the design of the suction opening and/or of the aspiration direction, the suction structuring, in particular the suction opening, is configured to suck in air from a cooking hob section, particularly from all cooking hob sections, on which a cooking zone is accommodated.

The suction opening of the extraction device, which is arrangeable on different height positions, may be located on or just above a level of a rim of a pot or any other type of cookware, which is positioned or positionable on a cooking zone of the cooking hob. Preferably, the height position of the suction opening is adjusted to the highest one of a number of pots or cookware items. That way, cooking vapours from all operated cooking zones may almost entirely be captured.

Said capturing of the cooking vapours from all cooking zones may even be improved by providing a specifically designed shape of the suction head. For example, the suction head may be rectangular or quadratic, but connected to the suction base in a rhombic way, i.e. connected to the suction base with one corner of the rectangle or square. This leads to an orientation of the four lateral surfaces of the suction head towards the four cooking zones, which is particularly favourable when on each one of the lateral surfaces suction openings are arranged. That way, the cooking vapours generated on each one of these four cooking zones are directly sucked in by the suction opening directed towards the respective cooking zone. In fact, the shape of the suction head may not be limited to square or rectangle, also other shapes may be selected, e.g. a circle, an oval or a square or rectangle with rounded corners.

Particularly, the suction arm is configured to be arranged at a height position on the level of a top surface of the cooktop. A particularly preferred solution provides for a configuration, in which the suction arm, notably an upper side thereof, is flush with the top surface of the cooktop. This height position on the level of a top surface of the cooktop may form an inactive state of the extraction device, e.g. a rest position. In this case, the suction arm preferably forms a section of the cooktop surface, particularly providing a continuous surface. Alternatively, the extraction device may be operable in this height positioning as a downdraft extraction device with a suction opening facing upwards. To this end, the suction head comprises either a suction opening on its top side or, alternatively, a suction opening on its bottom side, wherein the suction head is configured to be turned upside down. The optionally provided suction opening on the top side of the suction head may be arranged in addition to another suction opening or the other suction openings, which are arranged on the bottom side or on at least one lateral side of the suction head. There may also means for individual activation and/or deactivation of suction openings be provided.

Preferably, the top surface of the suction arm blends in nicely with the cooktop surface in its rest position. To this end, said top surface may be made of the same material as the surface of the cooktop. Optionally, a frame part surrounding the top surface of the suction arm may also cover the edges of the cutout, in which the suction arm sinks in when moving into the rest position. Said frame particularly covers the gap between the top surface of the suction arm and the surface of the cooktop.

The suction head in addition, or alternatively, may be configured to be horizontally shifted, particularly towards a position directly above one cooking zone of the cooking hob. By this means, a positioning of the suction opening directly above the cooking zone for a direct aspiration of the vapours generated on this cooking zone is achieved. Any swivelling means may be arranged at either end of the suction base and/or even at the connection point between suction base and suction head.

One embodiment of the present invention is characterized in that the suction base is constructed in segments, which may allow an individual length adjustment by using a respective number of segments. An additional or alternative embodiment may be characterized by a permanent availability of length adjustability, so that an adjustment at any time is possible. Preferably, the suction base comprises a telescopic extension means, which allows a simple retraction and extracting between the telescope segments as needed.

The suction head may be movable from a first position to a second position by a mechanical actuation performed by the user of the extraction device. In order to facilitate the mechanical actuation, the user may be supported by a spring force, which may provide at least in an initial phase a spring-loaded lifting of the suction arm. In the other direction, for bringing the suction arm down to its resting position, e.g. flush with the upper surface of the cooktop, the user may be forced to act against said spring force and to engage a locking mechanism. A release of said locking mechanism for lifting again the suction arm is preferably performable by operating a push-push locking mechanism.

As an alternative, the suction arm may be moved by means of an automated, preferably electrically driven, adjustment device. This further simplifies the handling with the extraction device, in particular by provision of a servomotor that allows an easy move to position. Furthermore, such an automated positioning of the suction arm enables a direct positioning on a switch-on of the extraction device or of the cooking hob, e.g. to a standard operating position, so that the user just may finally adjust to an individual position, if needed or desired. On the other hand, upon switch off, the automated adjustment device may automatically move the suction arm to the rest position, i.e. notably flush with the cooktop surface. The automated adjustment device may be controlled by remote control means operated by the user or, alternatively, in a self-regulated manner, e.g. by a respective software input.

According to an embodiment, the base or bottom of the suction base rests on a central point or central area of the cooking hob, particularly of the cooktop, and is vertically extendable. This specific embodiment is comparable to a lifting platform with a central lifting gear, which may be designed as a single or multiple stage telescopic cylinder. Another specific embodiment provides for a base or bottom of the suction base, which is arranged or arrangeable at or close to a rear edge of the cooking hob, in particular in or close to a centre of the side edge, in a pivotable manner. In particular for moving into an operating position, the suction base is orientable in an inclined manner and particularly extendable in an inclined direction.

The suction arm, more specifically the suction head of the suction arm, may include a filter element for filtering out odours and/or pathogens, e.g. by using a photocatalytic system and/or an UV led system, and/or particles or droplets. Said filter element is particularly a releasable filter element, allowing servicing activities thereon. Moreover, the filter element is preferably arranged next to and/or accessible through the suction opening, so that there is no need for a disassembling of the suction arm. The suction arm may also include the previously mentioned fan for sucking in the air from the area above the cooking hob. That way, the stationary bottom unit of the extraction device may only comprise an exhaust outlet for an air exit into the atmosphere, i.e. into ambient air.

One embodiment of the present invention is characterized in that the suction arm comprises at least one of the following supplementary elements: a sensor means, a presence or proximity sensor, a device or component for an assisted cooking functionality, lighting means, a camera, acoustic input and/or output means, a user interface and/or control means, a cookware accessory device, a temperature sensor, a lid lifting device, a scale device and a device for steam generating and/or steam supply. The sensor means may be configured to measure the temperature of a cookware placed on a cooking zone and/or food contained therein, e.g. by an infrared sensor means. The temperature sensor means may also be used for measuring the temperature of a pot lid, more specifically of the lid of a steam or pressure pot. Depending on the measured temperature, a safety note may be provided and/or a power reduction or a switch-off of the related cooking zone may be executed. There may also a humidity sensor be provided measuring the humidity rate, which may also be one basis for assisted cooking. Another sensor means for a detection of volatile organic compounds (VOC) may be included as well. The humidity sensor and/or the VOC sensor is or are preferably provided for autoactivation and controlling the extraction device. A further specific sensor means that may be included, is a presence or proximity sensor, which may be used for identifying a user to move up to the cooking hob, so that in preparation of a beginning cooking process the extraction device may be made ready as well, what means that the suction arm is already automatically moved to an operating position, particularly from a rest position towards the user positioned in front of the cooking appliance.

Said device or component for an assisted cooking functionality is particularly a stirring motor configured to be equipped with a stirring arm or a stirring motor with a stirring shaft configured to be equipped with a stirring tool, particularly a stirring edge. Said stirring tool or edge may be a replaceable component and interchangeable or substitutable by another stirring tool or edge, specifically having a different shape in order to provide the opportunity to meet a proper stirring function. Depending on the actual food preparation phase a stirring process of the food on the cooking zone may be automatically performed, e.g. following a respective advice in a cooking recipe. The stirrer may be a standard unit, but particularly it is an accessory being configured to integrate into the suction head or suction base, where a motor may be arranged for performing the rotation of the stirring device. Specifically in the case of a horizontally moveable suction arm, the stirring function may be provided at different horizontally displaced operation places, more specifically at different cooking zones of the cooking hob. In this case, the suction arm may be configured to be moved toward the respective zone. Alternatively, the stirring function may be provided at a fixed position, in particular allocated to a fixed cooking zone, what means that suction arm may be fixed or fixable at the specific place, specifically when the stirring function is or shall be executed.

The lighting means may be arranged in the suction head and/or in the suction base and may be designed to illuminate at least a section of the cooktop, preferably the entire cooktop. Moreover, additionally, or alternatively, the lighting means may be activatable for ambient illumination, which particularly may be performed or performable, when the extraction device is not operated, more specifically, when no cooking process on the cooking hob takes place. While the activation of the lighting device in connection with an operated extraction device, especially during a running cooking process, may be executable by means of either a user's activation, e.g. by a manual or a voice control action, or an automated control, e.g. by a software application. The activation of the lighting device for ambient illumination purposes may be essentially executable by a user's control, in particular by using wireless control functionality or by a switching activation of a respective key or sensing means of a control panel. A lighting source of the lighting means is preferably at least one illumination bar or lamp, specifically using LED technology. Advantageously, the light emitted from the lighting source is tuneable in its frequency and/or intensity, which is favourable for obtaining an appropriate illumination of the food or means that shall be prepared. Preferably, the illumination is performable or performed in such a way that the visual perception of the illuminated items or surfaces is not altered in order to guarantee a best possible illustration. Said tuning may be performable, especially by means of a respective control board, by a manual or an automated adjustment of frequency and/or intensity, preferably taking into account ambient light information. Furthermore, the lighting device may be configured to serve the purpose of sanitization of surfaces, in particular of the surface of the cooking hob. More specifically, the light source, e.g. based on LED technology, may have an intensity, especially a wavelength intensity, which causes a sanitization of the irradiated surface.

Said camera may be implemented for monitoring cookware or food contained therein, so that cooking parameters may be modified in dependence on the identified progress of the cooking process. Alternatively, the user may be guided during the cooking process after processing, specifically by means of a control unit of the extraction device, the information received from the camera and/or from any sensors. The camera, which may be integrated in the suction head or the suction base, may also be used for being linked with internet of things (IoT) or for an automatic positioning of the suction head, in particular by monitoring the cooktop surface and automatic identification that a specific cooking zone is activated, namely in that cookware is placed thereon. Moreover, the camera may be comprised in a food recognition system. Data received and forwarded by the camera may be processible by an algorithm, with the target to deduce the food observed by the camera. With the information derived from the data, more specifically from the food data, a cooking program and/or cooking parameters may be selectable. Such selection may be made by a user or by software solution. In some implementations, camera data and/or food recognition information are provided on a user's mobile and/or computer device, e.g. on a smartphone using a specific software application. Forwarding of the information may be performed by wireless means, in particular via a Bluetooth connection. Finally, the camera may be a component of a gesture recognition system. This system may be configured to detect specific user's gestures, resulting in activation and/or deactivation of particular functionalities of the cooking hob and/or the extraction device. The camera may be configured to be oriented and/or focused by any kind of control means, e.g. by a manual user input or by means of a voice control system. More specifically, an orientation of the camera may be changeable from a direction towards a cooktop of the cooking hob to a direction towards a user's position. Additionally, or alternatively, at least two cameras may be included in the extraction device for a more flexible operation thereof.

The acoustic input and/or output means are particularly provided for voice input and/or output for a hands-free operation of the extraction device and/or of the cooking hob, which appliances may be interconnected.

The user interface may be provided for any control or information inputs by the user or for information output, e.g. of any food preparation state, to the user. Moreover, said control means may be configured to control or operate the extraction device.

The cookware accessory device, which may be integrated in the suction head or in the suction base, is particularly a cookware accessory element, which acts on a pressure valve, more specifically a pressure valve integrated in a steam and/or pressure pot, e.g. in a lid thereof. With such means, a safety device may be provided, particularly by said cookware accessory device controlling the pressure inside of such types of pot by acting on the pressure valve. The cookware accessory device may also be configured to lift the lid of a pot in order to influence a cooking process, particularly an automated cooking process. Sudden increase of steam formation above the cooktop, which may result from a pressure valve release or a lid lifting, may be evacuated by a simultaneous increase of the suction power of the extraction device.

The scale device may be provided for weight measurement and is particularly integrated in the suction head. More specifically, the suction head comprises a load cell and/or a weighing accessory, so that a weighing activity, particularly during a food preparation and/or a cooking process, is performable.

The steam generating and/or steam supply device, which may also be implemented in the extraction device, more specifically in the suction head or suction base, may address steam into cookware or on a surface, especially for supporting the cooking process and/or for a cleaning process. For steam generation a water container may be integrated in or on the cooking hob or in the suction arm. The generated steam may be guided through the suction arm, more specifically through the suction base. The steaming process may be performed through the suction head, where related steam outlet openings may be arranged. A top-down steaming process may be executable. The suction arm, particularly the suction head of the suction arm, and/or the steam outlet openings may be controllable, especially such that the steam may be directable towards the cookware or surface to be supplied with steam.

In some implementations, at least one of the previously described supplementary elements is assignable to a specific cooking zone. Alternatively, the at least one supplementary element may be configured to be assigned to at least two different cooking zones, which may be varyingly selectable.

One embodiment is characterized in that the suction arm includes at least one electric connection cable for electric supply and/or for signal transfer, which is preferably run in the interior of the suction base. That means that the suction arm, more specifically the suction base, not only provides an air duct for air conveyance, but also accommodates the wiring for any electric components arranged in the suction head.

According to another embodiment, the suction arm is removable from the extraction device, which advantageously defines a modular design for the suction arm. The removability is particularly supported by a pluggable air duct connection.

The above-mentioned object is achieved for a combination appliance according to the features of claim 13. Accordingly, a combination appliance comprises the extraction device according to anyone of the afore-described embodiments and a cooking hob.

Said cooking hob comprises a cooktop and at least two cooking zones. As will be readily understood by the skilled person, all previously mentioned and described features and related advantages of the extraction device above are fully applicable to the combination appliance comprising such extraction device.

Finally, the object is also achieved by a suction arm according to the features of claim 14. Accordingly, a suction arm configured to be used in or to be connected to an extraction device comprises a suction head and a suction base. More specifically, the suction arm is configured to be used in or to be connected to an extraction device according to anyone of the afore-described embodiments. Said suction head comprises a suction opening for sucking in air from an area above a cooktop of a cooking hob. Moreover, said suction base is of a tube-like or channel-like configuration and includes a first end and a second end. The first end is connected to the suction head, which connection particularly includes a mechanical connection as well as an airflow connection. The second end comprises a first connection piece, more specifically a first airflow connection piece, for a removable connection of the suction arm to a second connection piece, more specifically a second airflow connection piece, which is included in a stationary bottom unit of the extraction device. Said first and second connection pieces interact with each other. Preferably, the suction arm also comprises a filter element and/or a fan for air conveyance. That way, a fully independent modular suction arm may be provided, which may be connected to different models of combination appliances.

One specific embodiment of the suction arm further comprises at least one electric connection cable for electric supply and/or for signal transfer. Said connection cable is preferably run in the interior of the suction base. Further, electrical connection means are included, which are preferably arranged at the second end of the suction base and configured to be coupled with related electric connection means of the stationary bottom unit.

Novel and inventive features of the present invention are set forth in the appended claims.

The present invention will be described in further detail with reference to the drawings, in which FIG. 1 is a perspective view of a combination appliance comprising a cooking hob and a first embodiment of an extraction device;

Figure 1:
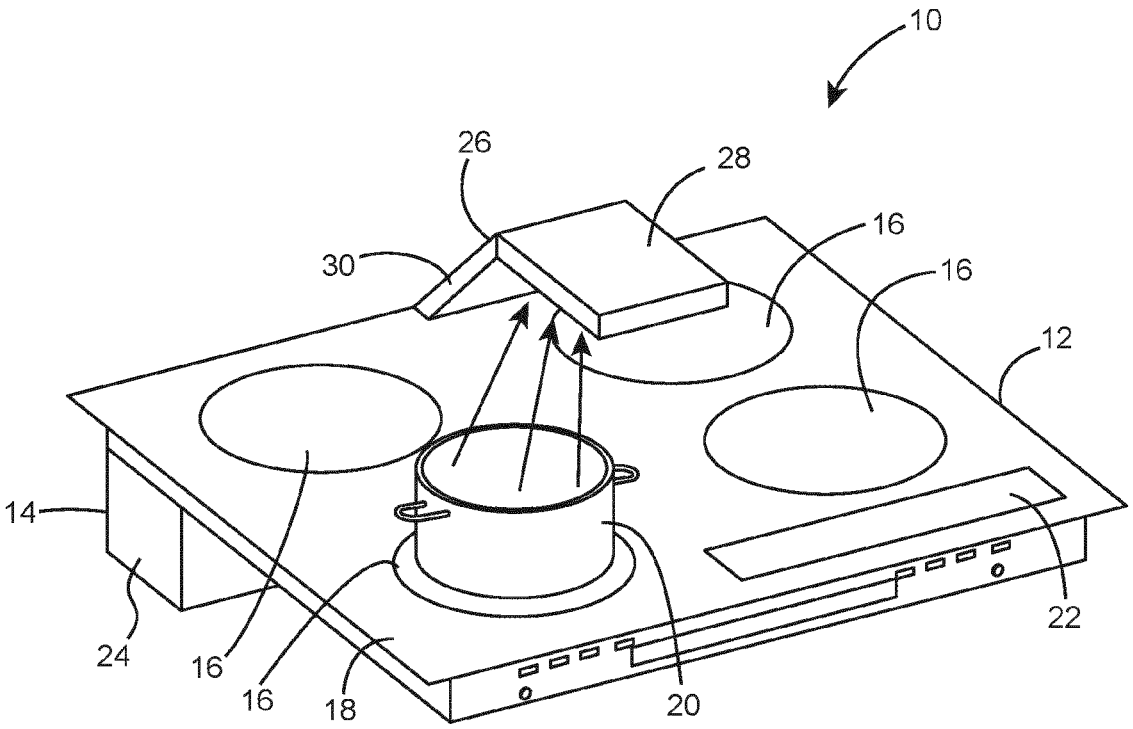
Figure 2:
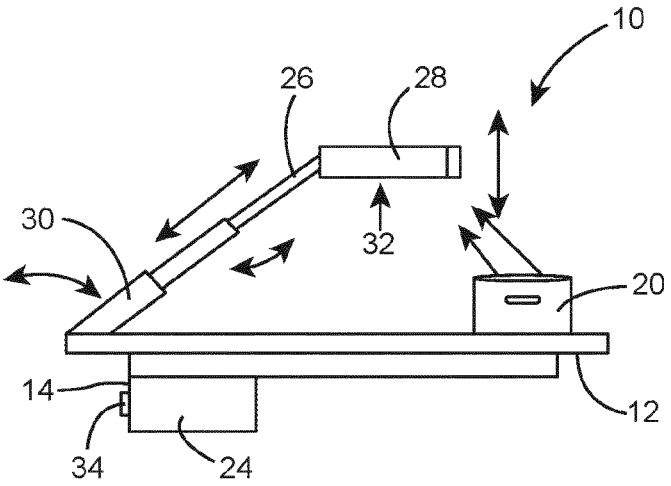
FIG. 2 is a schematic side view of the combination appliance according to FIG. 1.
Figure 4A:
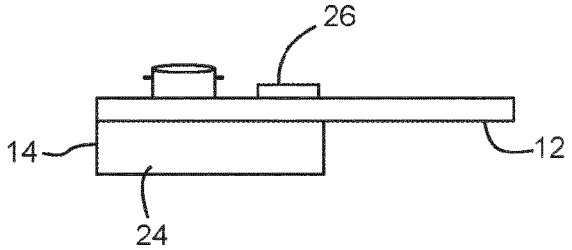
Figure 5A:
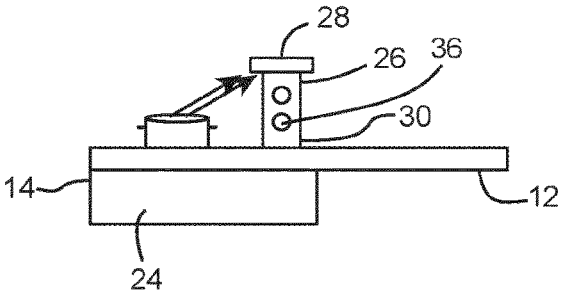
Figure 5B:
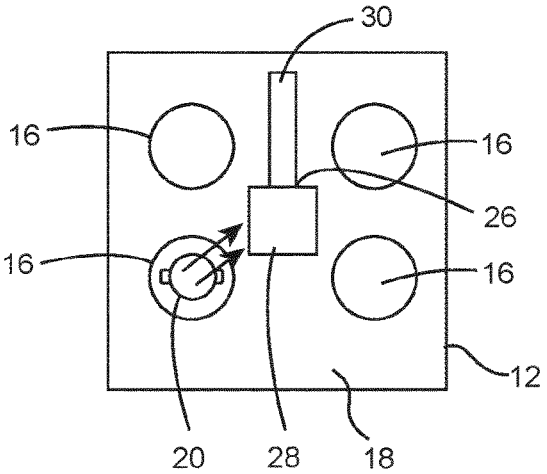
Figure 4C:
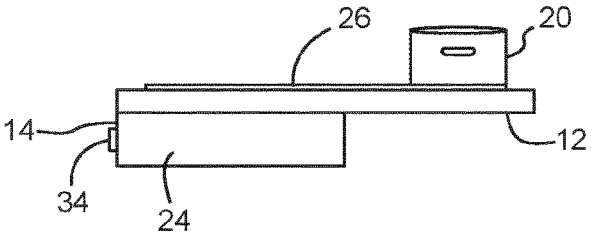
Figure 5C:
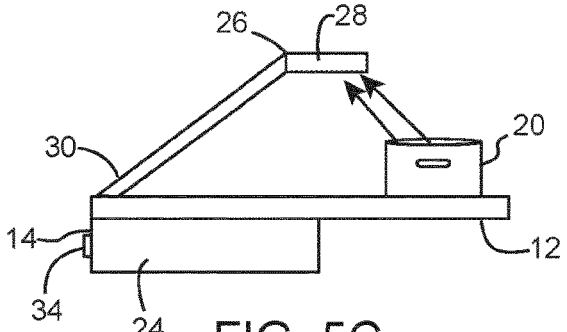
Figure 6A:
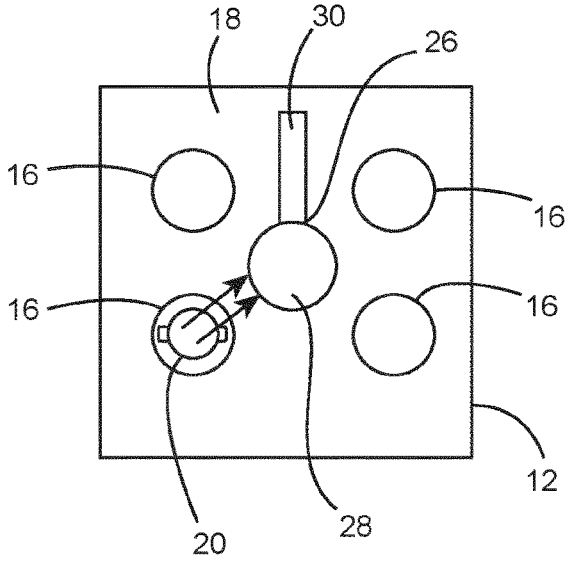
Figure 7:
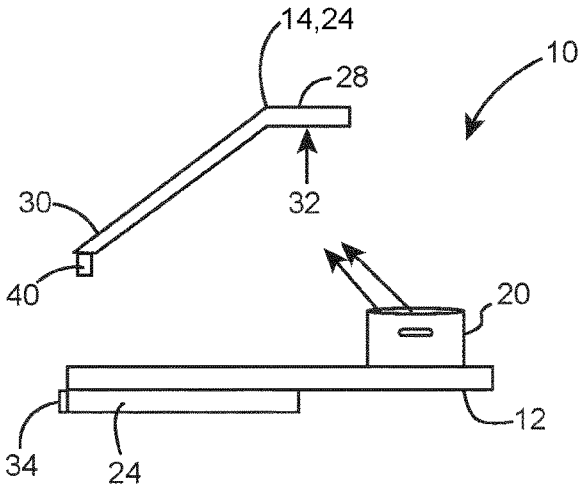

FIGS. 4A,B,C schematically illustrate a front, a top and a side view of the combination appliance according to FIGS. 1 and 2, in a rest position of the extraction device;

FIGS. 5A,B,C schematically illustrate a front, a top and a side view of the combination appliance of FIGS. 4A,B,C with a suction arm of the extraction device in an operating position;

FIGS. 6A,B are schematic illustrations of the combination appliance according to FIG. 5B, but with modified designs for the suction head of the extraction device; and FIG. 7 schematically illustrates a combination appliance similar to FIG. 2, but with a third embodiment of the extraction device.

In all figures the same or equivalent part are marked with the same reference numbers.

FIGS. 1 and 2 illustrate schematically a combination appliance comprising a cooking hob 12 and a first embodiment of an extraction device 14. The cooking hob 12 is designed to be installed in a cutout of a kitchen countertop. The extraction device 14 is configured to take away cooking vapours occurring during cooking processes, in particular when cooking with uncovered cookware takes place. The cooking hob 12 comprises four cooking zones 16 indicated by circles imprinted on a cooktop 18 of the cooking hob 12. Cookware is placeable on the cooking zones 16 for performing the cooking process, indicated by pot 20 in the figures.

The cooking zones 16 are heated by means of heating elements (not shown) arranged underneath and close to the cooktop 18. Said heating elements may be of electric nature, but other heating systems like gas cooking elements are considerable as well. One preferred cooking solution is induction cooking and, respectively, the heating elements are induction coils.

The cooking hob 12 is operable by a user of the combination appliance 10 by means of a user interface 22, which is arranged at a front edge of the cooktop 18, either laterally arranged as in FIG. 1 or centrally arranged. The user interface 22 may include any types of control units for providing control inputs to a control unit of the cooking hob 12. The present example is characterized by touch control elements and the control inputs are provided by the user on a touch surface of the user interface 22.

The extraction device 14 according to the first embodiment comprises a stationary bottom unit 24 arranged underneath the cooking hob 12 and a suction arm 26 arranged above the cooking hob 12 and coupled with the stationary bottom unit 24 through a cutout on the rear side of the cooking hob 12. The suction arm 26 is composed of a suction head 28 and a suction base 30. A first end of the suction base 30 is coupled with the suction head 28 and a second end is connected to the stationary bottom unit 24.

The entire extraction device 14 operates in that the suction head 28 sucks in the cooking vapours through a suction opening 32 located on a bottom side of the suction head 28. After having been sucked in, the air with the cooking vapours passes a filter unit (not shown) arranged in the interior of the suction head 28 and accessible through the suction opening 32 for servicing activities. The filter unit comprises a grease filter for filtering out grease particles and droplets. Optionally, also an odour filter is included for removing odours from the aspirated air. Alternatively, the odour filter may be arranged at another position of the air route inside of the extraction device 14, e.g. directly at the end of said air route, i.e. before the air is blown out as exhaust air into the atmosphere.

After having passed the filter unit, the air is conveyed through an air channel inside of the suction base 30 and, thereafter, through the interior of the stationary bottom unit 24 up to an outlet opening 34, through which the exhaust air escapes into ambient air.

As visualized by FIGS. 1 and 2, the first embodiment of the extraction device 14 is designed like a hanging parasol with the suction base being arranged in an inclined orientation directed to a central axis (not illustrated) of the cooking hob 12. In the area of said central axis, but in a raised position above the cooktop 18, which position is located above a central area of the cooktop surface, the suction head 28 is arranged. Said central area of the cooktop 18 is also in the midst of and the closest position to all four cooking zones 16.

The airflow through the extraction device 14 is performed by an exhaust fan, which may be included in the interior of the stationary bottom unit 24. The speed of the fan, which influences the flow rate of the airflow, may be modifiable, in particular dependent on the number of activated cooking zones 16, which modification may be performed by a respective selection by the user, e.g. by a manual selection or via any voice control means, or automatically based on any software input. Such kind of autoregulation of the fan speed or conveying capacity may be performed by processing data provided by the cooking hob 12 or by sensor information, in particular temperature and/or humidity and/or VOC sensor data.

The arrangement of suction base 30 and suction head 28 may be a rigid and inflexible one as visualized by FIG. 1, so that the suction head 28 always stays at the same position.

Alternatively, according to the illustration of FIG. 2, the position of the suction head 28 may be changed by respective adjusting means. Said adjusting means are configured to enable a displacement in different ways.

A first position change can be performed by a modification of the inclination of the suction base 30. To this end, the second end of the suction base 30 may be connected to the stationary bottom unit 24 by means of a hinge. In order to keep a parallel alignment of the suction head 28 with the surface of the cooktop 18 when modifying said inclination, the coupling between suction head 28 and suction base 30 may also be performed by means of a hinge.

A second position change concerns a horizontal displacement of the suction head 28, which is executable by a rotational movement of the second end of the suction base 30 around a vertical axis, which goes through the connection point between suction base 30 and stationary bottom unit 24. Such kind of displacement allows a movement towards a specific cooking zone 16, so that the suction head 28 is positioned directly above this cooking zone 16, e.g. if only this cooking zone 16 is operated.

Finally, a third position change is executable by a length adjustment of the suction base 30. For this purpose, the suction base 30 is telescopically extractable.

All three afore-described position change mechanisms allow a three-dimensionally displacement of the suction head in order to arrange it at the most convenient location for a best performance suction of cooking vapours, particularly providing an adjustability to the operated cooking zones 16 and the height of the used cookware 20.

Figure 3A:
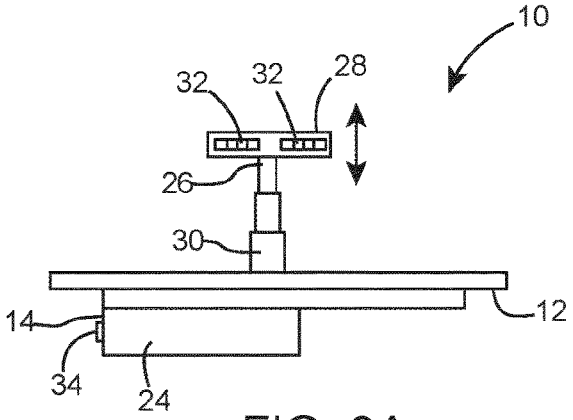
FIG. 3A is a schematic side view of a combination appliance similar to FIG. 2, but with a second embodiment of the extraction device.

FIG. 3A schematically shows a combination appliance similar to FIGS. 1 and 2, but with a second embodiment of the extraction device 14. Similar to the first embodiment, the extraction device 14 of FIG. 3A comprises a stationary bottom unit 24 including the exhaust fan and arranged underneath the cooking hob 12, as well as a suction arm 26 arranged above the cooking hob 12 and coupled with the stationary bottom unit 24 through a cutout of the cooking hob 12. Said cutout, however, is arranged at a centre point of the cooking hob 12. Here as well, the suction arm 26 is composed of a suction head 28 and a suction base 30, wherein a first end of the suction base 30 is coupled with the suction head 28 and a second end is connected to the stationary bottom unit 24.

The second embodiment of the extraction device 14 is characterized by an only vertical changeability of the position of the suction head 28, realized by an upright and telescopically extractable suction base 30 for a height adjustment. As with the previously described first embodiment, the height position can be adapted e.g. to the height of the cookware used for the actual cooking process.

Figure 3B:
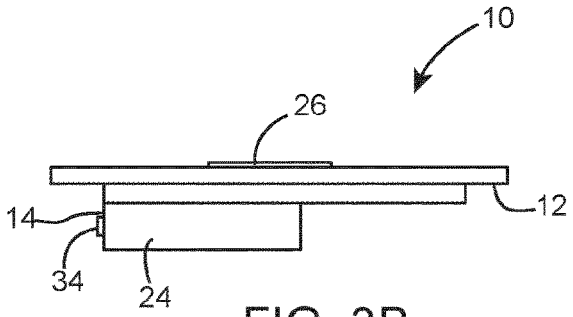
FIG. 3B illustrates the combination appliance according to FIG. 3*a* but with a suction arm of the extraction device in a rest position.

The suction arm 26 is designed to move to a rest position after finalizing the cooking process, which adoption of the rest position is visualized in FIG. 3B. The telescopically extractable suction base 30 has been retracted in that way that the top surface of the suction head 28 is flush (or nearly flush) with the surface of the cooktop 18. Of course, a respective space underneath the cooktop 18 is conceded for the accommodation of the retracted suction base 30. In this rest position, in which the extraction device 14 is inactive, the top surface of the suction arm 26 may blend in with the cooktop surface, which is realized in that said top surface is made of the same material as the surface of the cooktop 18, namely made of glass ceramics.

Naturally, the just described parking of the suction arm 26 in the rest position can be also implemented in the first embodiment according to FIG. 2. This specific feature is schematically illustrated by FIGS. 4A,B,C and 5A,B,C, wherein both sets of figures show a front, a top and a side view of the combination appliance 10 either according to FIG. 1, but with the possibility to change the inclination of the suction base 30 of its extraction device 14 and to park it in a rest position, or according to FIG. 2. While the adoption of the rest position of the suction arm 26 is presented by FIGS. 4A,B,C, the respective illustrations of FIGS. 5A,B,C visualize the active, i.e. the operating position thereof.

When moving from the operating position, in which the suction head 28 is horizontally and the suction base 30 is diagonally arranged, so that these two elements include an obtuse angle, the rest position is characterized in that the top surfaces of the suction base 30 is flush with the top surface of the suction head 28. The respective change of the angle between suction base and suction head 28 is enabled by means of a hinge. Alternatively, an outer shell of suction head 28 and suction base 30 may be made in one piece with elastic material, providing a flexible adaptation of said angle to the respective position the suction arm 26 is adopting.

Moreover, a front face 38 of the suction head 28 (alternatively its top side), which is specifically visible in FIG. 5A, may also include a user interface (not shown). This means, that this user interface comes towards the user, when the suction arm 26 moves from its rest position to its operating position, what may end up in a facilitated control input or improved perceptibility of display means on said user interface The user interface arranged at the suction head 28 may be a satellite user interface interacting with the user interface 22 on the cooking hob 12, or it may be a sole user interface for the entire combination appliance 10 in that replacing the user interface 22 of the cooking hob 12.

Further, FIG. 5A also illustrates sensor means 36 on a bottom surface of the suction body, which bottom surface faces the user in diagonally direction. Said sensor means 36 may be configured to measure temperature of the cookware 20 or the food contained therein, and/or to measure humidity and/or to detect volatile organic compounds. All said measuring or detection incidents may be used for providing respective signals to control means of the extraction device, which information may be used for an assisted cooking functionality, the combination appliance 10 may provide.

One of the sensors 36 illustrated in FIG. 5A may also be a camera for monitoring the cooking process, which information also can be used as input for such assisted cooking. Moreover, said camera may also provide information about the number (and the respective positions) of operated cooking zones 16, resulting e.g. in the previously mentioned automatic fan speed adjustment.

Figure 4B:
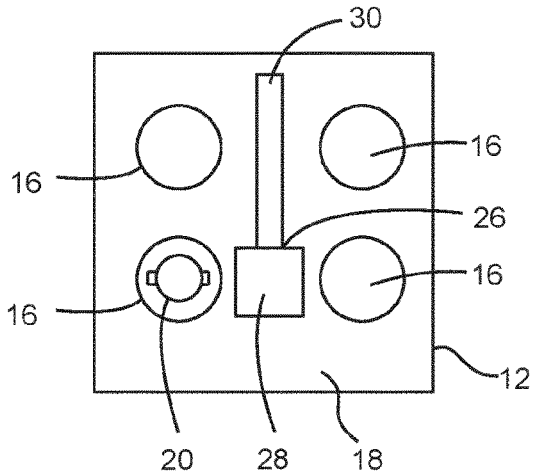
Figure 6B:
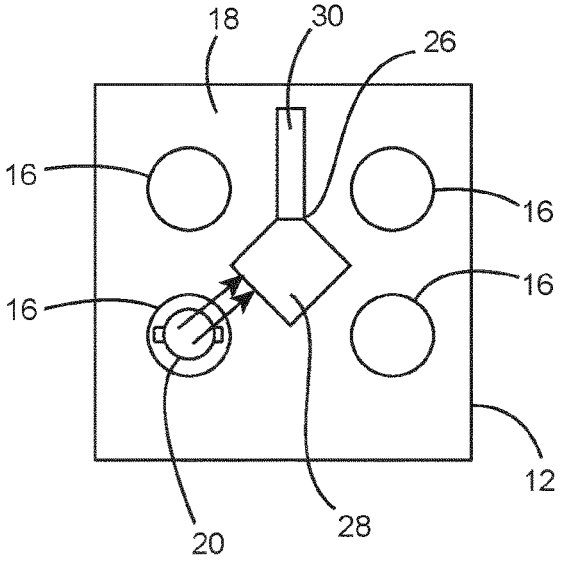

FIGS. 6A and 6B present two different designs for the shape of the suction head 28 compared to the shape illustrated in FIGS. 4B and 5B. The suction head 28 may be designed as a circular disk (FIG. 6A) or quadratic, but connected to the suction base in a rhombic way, i.e. connected to the suction base with one corner of the square (FIG. 6B). Both design examples according to FIGS. 6A and 6B may comprise a suction opening 32 on their bottom sides, either in a flat or bowl-shaped or cone-shaped form. However, the shape according to FIG. 6B is favourably combined with suction openings in lateral surfaces, which results in an orientation towards the four cooking zones. That way, the cooking vapours generated on each one of these four cooking zones are directly sucked in by the suction opening 32 directed towards the respective cooking zone 16.

Finally, FIG. 7 schematically shows a combination appliance 10 with a third embodiment of an extraction device 14, which is constructed modularly. This embodiment of the extraction device 14 includes all components for an air conveyance and filtering inside of the suction arm 26. Therefore, the stationary bottom unit is reduced to just a box with an inlet opening, which provides also the counterpart for a connection pipe 40 on the second end of the suction arm 26 and an internal air duct towards the outlet opening 34. The filter elements and/or the fan may be arranged in the suction head 28 and/or in the suction base 30.

It is to be noted that the detachability of the suction arm 26 also may be provided in the embodiments according to FIGS. 1 to 6B, particularly for service activities, e.g. for a cleaning of the suction arm 26. This means that the fan can stay arranged in the stationary bottom unit 24. If such structuring may be provided as a low-cost solution, being just a unit with air inlet, air conveyance and filtering, but without any electric or electronic components, this type of suction arm 26 can be designed as a solid block, containing a grease filter, which then provides an easy accessibility for cleaning activities.

Although illustrative embodiments of the present invention have been described herein with reference to the accompanying drawings, it is to be understood that the present invention is not limited to these precise embodiments, and that various other changes and modifications may be affected therein by one skilled in the art without departing from the scope or spirit of the invention. All such changes and modifications are intended to be included within the scope of the invention as defined by the appended claims.

Moreover, features which are described in the context of separate aspects and embodiments of the invention may be used together and/or be interchangeable. Similarly, features described in the context of a single embodiment may also be provided separately or in any suitable sub-combination.

LIST OF REFERENCE NUMERALS

10 combination appliance
12 cooking hob
14 extraction device
16 cooking zones
18 cooktop
20 pot
22 user interface
24 stationary bottom unit
26 suction arm
28 suction head
30 suction base
32 suction opening
34 outlet opening
36 sensor
38 front face
40 connection pipe

The invention claimed is:

1. An extraction device for removing air comprising cooking vapors from an area above a cooking hob, the extraction device comprising:

a suction arm including a suction head, which comprises a suction opening, and a suction base, which comprises an air duct configured to conduct the air, the air duct being arranged downstream of the suction opening, wherein the suction base has a first end connected to the suction head and a second end comprising a first connection piece configured for a removable connection of the suction arm to a second connection piece included in a stationary bottom unit of the extraction device, the second connection piece interacting with the first connection piece, a fan configured to suck in the air from the area above the cooking hob through the suction opening and the air duct, a filter element configured to remove particles and/or droplets and/or odors from the air sucked in, which filter element is arranged or arrangeable upstream of the fan, an outlet opening configured to exhaust the air, at least one electric connection cable configured for electric supply and/or for signal transfer, which is run in an interior of the suction base, and electrical connection means arranged at the second end of the suction base and configured to be coupled with related electric connection means of the stationary bottom unit, wherein the suction arm is centrally arranged or arrangeable in relation to the cooking hob or is arranged or arrangeable midway between lateral edges of the cooking hob, such that both a center or centerline of the suction arm and a centerline of the cooking hob lie in one plane that is vertically oriented, and a position of the suction head and/or of the suction opening is changeable from a first position within boundary lines of and at least approximately at a height level of a cooktop of the cooking hob to a second, elevated position above the height level of the cooktop, and wherein the suction base of the suction arm is pivotally connected or connectable to the cooking hob such that the suction base is pivotable about a vertical pivot axis.

2. The extraction device according to claim 1, wherein the suction opening is arranged:

on a bottom side of the suction head, accomplishing a flat or a bowl-shaped or a cone-shaped aspiration direction, or on at least one lateral surface of the suction head in order to facilitate suction in an at least approximately horizontal direction, and wherein the suction opening is configured to suck in air from a cooking hob section on which a cooking zone is accommodated.

3. The extraction device according to claim 1, wherein the suction opening of the extraction device is arrangeable at different height positions, at or just above a level of a rim of a pot, which is positioned or positionable on a cooking zone of the cooking hob.

4. The extraction device according to claim 3, wherein a top side of the suction arm is configured to be arranged at a height position at a level of a top surface of the cooktop, flush with the top surface of the cooktop, wherein in said height position:

i. the extraction device assumes an inactive state in which the suction arm forms a section of the cooktop surface, or ii. the extraction device is operable as a downdraft extraction device with the suction opening facing upwards, wherein the suction head:

comprises said suction opening on its top side, or comprises said suction opening on its bottom side and is invertible.

5. The extraction device according to claim 1, wherein the suction head is configured to be horizontally shifted, towards a position directly above one cooking zone of the cooking hob.

6. The extraction device according to claim 1, wherein the suction base is constructed in segments and/or is length adjustable.

7. The extraction device according to claim 1, wherein the suction head is movable from a first position to a second position:

by means of an automated, electrically driven, adjustment device, or by mechanical actuation, supported by spring force and/or including a release of a locking mechanism.

8. The extraction device according to claim 1, wherein a base or bottom of the suction base:

rests on a central point or central area of the cooking hob and is vertically extendable, or is arranged or arrangeable at or close to a rear edge of the cooking hob in a pivotable manner and is orientable in an inclined manner and extendable in an inclined direction.

9. The extraction device according to claim 1, wherein the suction arm includes a releasable filter element configured to filter out odors and/or pathogens and/or particles or droplets, which is arranged next to and/or accessible through the suction opening.

10. The extraction device according to claim 1, wherein the suction arm comprises at least one supplementary element selected from a group of supplementary elements consisting of:

a sensor configured to measure temperature of cookware and/or food, and/or humidity or for detection of volatile organic compounds, a presence or proximity sensor, a stirring motor configured to be equipped with a stirring arm or a stirring motor with a stirring shaft configured to be equipped with a stirring tool, lighting means configured to illuminate at least a section of the cooktop, a camera configured to monitor cookware or food contained therein, acoustic input and/or output means for voice input and/or output, a user interface configured for control or information input or for information output and/or control means configured for controlling or operating the extraction device, a cookware accessory element acting on a pressure valve, a lid lifting device, a scale device, and a steam generating and/or steam supply device.

11. The extraction device according to claim 10, wherein the at least one supplementary element is assignable to a specific cooking zone, or is configured to be assigned to at least two varying cooking zones.

12. The extraction device according to claim 1, wherein the suction arm is removable from the cooking hob by a pluggable air duct connection.

13. A combination appliance comprising:

the extraction device according to claim 1, and the cooking hob, the cooking hob comprising a cooktop and at least two cooking zones, wherein the suction arm is centrally arranged in relation to the cooking hob or is arranged between lateral edges of the cooking hob, such that both the center or centerline of the suction arm and the centerline of the cooking hob lie in the one plane that is vertically oriented, and the position of the suction head and/or of the suction opening is changeable from the first position to the second, elevated position, and wherein the suction base of the suction arm is pivotally connected to the cooking hob such that the suction base is pivotable about a vertical pivot axis.

14. An extraction device for removing air from an area above a cooktop, the extraction device comprising:

a suction arm having an elongated suction base and a suction head pivotally connected to a first end of the suction base about a first lateral pivot axis, the suction base defining therein an air duct in fluid communication with an inlet opening in the suction head, the suction base extending forward along a centerline of said cooktop from a second end of the suction base adjacent to a rear of the cooktop and being further pivotally connected at said second end to a stationary bottom unit disposed beneath the cooktop about a second lateral pivot axis parallel to the first lateral pivot axis; and a fan disposed in said bottom unit and configured to suck said air in through said inlet opening;

wherein the duct in said suction base is also in fluid communication with an outlet opening of said bottom unit, wherein air sucked in through said inlet opening will be conducted through said duct and out to an ambient environment through said outlet opening;

wherein said suction arm is adjustable between a resting position and an operative position wherein said suction opening of the suction head is located above and adjacent to one or more of cooking zones of the cooktop; and wherein a height of said suction opening in the suction head relative to said cooktop is adjustable by adjusting a first pivot angle between the suction base and the cooktop relative to said second lateral pivot axis, wherein the suction base of the suction arm is pivotally connected to the cooking hob such that the suction base is pivotable about a vertical pivot axis, wherein said suction base is telescopically extensible, wherein through concurrent adjustment of said first pivot angle, a length of said suction base, and a second pivot angle between the suction head and the suction base relative to said first lateral pivot axis, said suction opening can be freely adjusted within a vertical plane substantially intersecting said centerline in the area above said cooktop, and wherein in said resting position, said elongated suction base and said suction head are received through one or more cut-outs within the cooktop so that upper surfaces of the suction base and suction head are substantially flush with a surface of said cooktop, said suction base further comprising at least one sensor configured to face the area above said cooktop when the suction base is deployed, to detect one or more of humidity, temperature, and optical images, and to communicate data to a controller that is configured to adjust a speed of said fan in dependence of said data.

15. The extraction device according to claim 14, wherein through concurrent adjustment of a lateral pivot angle of said suction base together with said first pivot angle, the length of said suction base and said second pivot angle, said suction opening can be freely adjusted within a three dimensional space in the area above said cooktop, unconfined by any particular plane.

* * * * *